United States Patent [19]

Bardunias

[11] Patent Number: 4,817,232

[45] Date of Patent: Apr. 4, 1989

[54] EASY CHIMNEY SWEEP

[76] Inventor: Michael Bardunias, 10 Meredith Dr., Greenlawn, N.Y. 11740

[21] Appl. No.: 77,662

[22] Filed: Jul. 24, 1987

[51] Int. Cl.[4] ..... F23J 3/00; A46B 17/00

[52] U.S. Cl. ..... 15/163; 15/249

[58] Field of Search ..... 15/160, 162, 163, 242, 15/243, 249

[56] References Cited

U.S. PATENT DOCUMENTS

| | | | |
|---|---|---|---|
| 739,435 | 9/1903 | Melcher | 15/249 |
| 1,320,887 | 11/1919 | Michels, Sr. | 15/249 |
| 4,138,758 | 2/1979 | Dodge et al. | 15/243 |
| 4,409,703 | 10/1983 | Marcellus | 15/249 |
| 4,498,208 | 2/1985 | Henderson | 15/163 |
| 4,583,258 | 4/1986 | Carroll | 15/243 |

FOREIGN PATENT DOCUMENTS

| | | | |
|---|---|---|---|
| 464295 | 1/1914 | France | 15/163 |
| 7777 | 8/1938 | United Kingdom | 15/249 |

*Primary Examiner*—Harvey C. Hornsby
*Assistant Examiner*—Joseph S. Machuga
*Attorney, Agent, or Firm*—Richard L. Miller

[57] ABSTRACT

This chimney sweeping device is designed to enable anyone to clean his or her own chimney. Primarily, it consists of a collar fitted to the top of a chimney, and a pair of rollers of the collar engage with a rope that is attached to one end of a chimney sweeping brush for pulling the brush upward the other end of the brush, being attached to a chain that is pulled to lower the brush. The device is further designed to remain in place of the chimney after removing the brush and the rope after operation, is tied to the chain and pulled clear of the interior of the chimney to prevent it from burning while the chain depends downward in the chimney.

2 Claims, 1 Drawing Sheet

Fig. 1
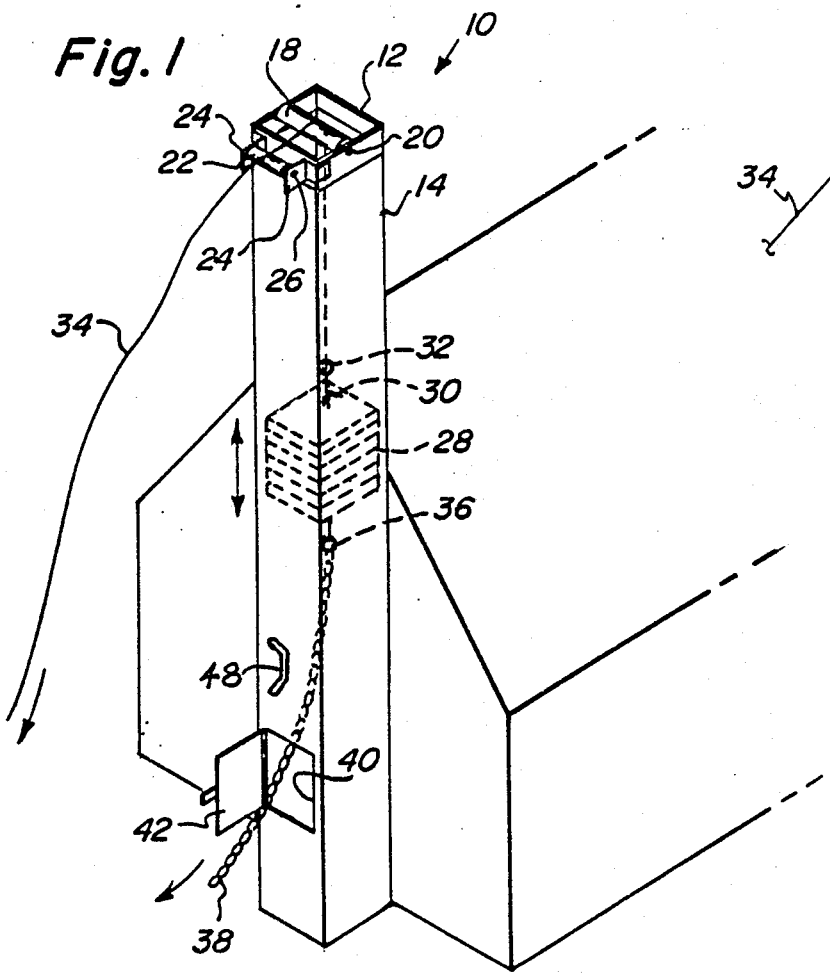
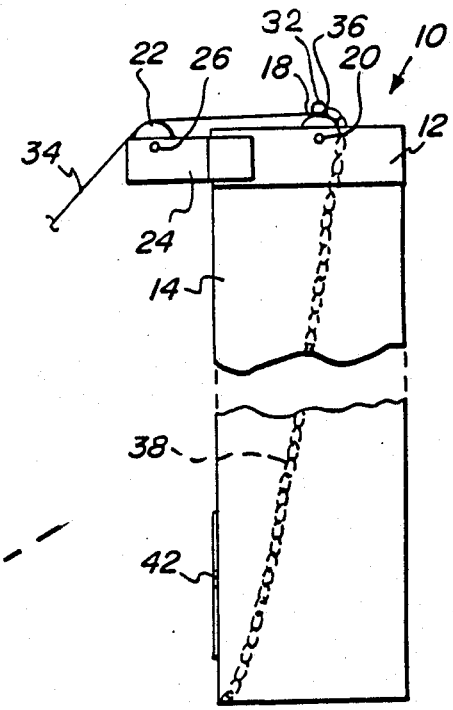
Fig. 3
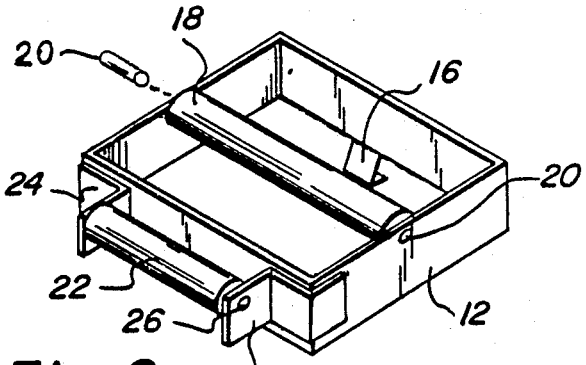
Fig. 2
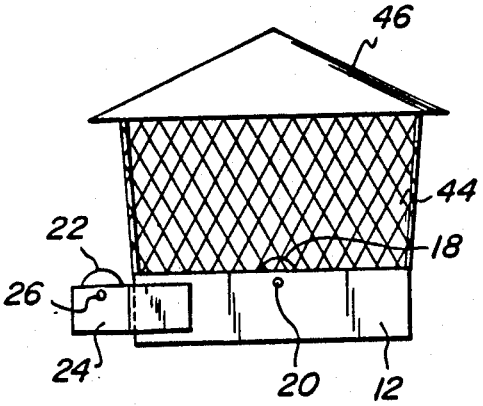
Fig. 4

EASY CHIMNEY SWEEP

BACKGROUND OF THE INVENTION

The instant invention relates generally to cleaning devices, and more particularly, to an easy chimney sweep.

Numerous chimney cleaning devices have been provided in the prior art that are adapted to scrape chimney structures. For example, U.S. Pat. Nos. 606,567 of Messenger, 4,216,249 of Clayton, and 4,200,339 of Lichliter et al all are illustrative of such prior art. While these units may be suitable for the particular purpose to which they address, they would not be as suitable for the purpose of the present invention as hereafter described.

SUMMARY OF THE INVENTION

A primary object of the present invention is to provide an easy chimney sweep that will overcome the shortcomings of the prior art devices.

Another object is to provide an easy chimney sweep that will enable a person to sweep their own chimney as often as necessary without fear of falling or sliding off of a roof.

An additional object is to provide an easy chimney sweep, which will be of such design, as to enable its user to scrape a chimney in any kind of weather.

A further object is to provide an easy chimney sweep that is simple and easy to use.

A still further object is to provide an easy chimney sweep that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of the invention mounted on the chimney of a house.

FIG. 2 is an enlarged diagrammatic perspective view of the bracket removed from the chimney showing further construction details with a pin exploded therefrom for clarity.

FIG. 3 is a diagrammatic side view of the chimney with parts broken away showing just the chain attached to the rope with the brush removed so as not to clog the chimney when not in use.

FIG. 4 is a side view of the bracket with hat and wire mesh to keep out birds, animals, rain etcetera.

DETAILED DESCRIPTION OF THE PREFERRED EMBODIMENTS

Turning now descriptively to the drawings, in which like reference characters denote like elements throughout the several views, FIG. 1 illustrates a device 10 that includes a square metal collar 12 that is positioned on the top of a clay pipe of the chimney 14 that protrudes out and up. If this clay pipe does not exist, then the clamp 16 fixedly secured to one side of collar 12, is employed to lock inside of the chimney 14 by screws in openings 17, (not shown).

A first roller 18 is mounted by pins 20 in the top portion of collar 12, and a second roller 22 is mounted between a pair of brackets 24 that are fixedly secured to the outside of collar 12. Pins 20 and 26 allow for rotation of rollers 18 and 22 without adding additional heat-retaining metal to device 10. A chimney cleaning brush 28 is provided for the cleaning of the inside of chimney and an eye 30 secured to one end of brush 28, receives a snap ring 32 fastened to one end of a rope 34 that engages with rollers 18 and 22, so as to pull brush 28 up in the chimney 14. A clip 36 on the other end of brush 28, fastens to one end of a fireproof chain 38 which may be pulled from opening 40 covered by a door 42.

Referring now to FIG. 4, collar 12 may be optionally provided with a wire screen 44 having a top hat 46, so as to keep birds and animals out.

In operation, the brush 28 is pulled upward by pulling on the rope 34, which causes the inside surfaces of chimney 14 to be cleaned. The rope 34 is then released and the chain 38 is pulled and causes the brush 28 to descend downward. The rope 34 may be pullled at an angle or straight down to elevate the brush 28 in its cleaning action. The above cycle is repeated as often as necessary, and when the operation has been completed, the brush 28 is removed from chimney 14, so as not to clog chimney 14. The chain 38 and the rope 34 are then secured to each other and the rope 34 is pulled to elevate the chain 38 in the chimney 14 and remove the rope 34 from the confines of the chimney, so as to keep rope 34 from burning when there is a fire going. Once this is completed the rope may be secured to an external and fixed fastener 48. The chain 38 provides a mechanism whereby the rope 34 can be retrived at will for replacement and removal of the brush 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A chimney sweeping device, comprising, a collar receivable on the top of a chimney;

a. a first roller;

b. a second roller;

c. means on said collar for rotatively mounting said first roller and said second roller thereto;

d. a rope;

e. a fireproof chain;

f. a cleaning brush having two ends, with said rope and chain removably attached to said brush in an assembly and said assembly adapted for engagement with said rollers to elevate and lower said brush inside said chimney;

g. clamp means secured to said collar for fastening said collar to said chimney;

h. an eye secured to one end of said brush;

i. a snap ring secured to one end of said rope;

j. a clip fixedly secured on the other end of said brush; and k. an external and fixed fastener, wherein said eye removably receives said snap ring, and said clip is removably received at said chain, and when said chain is pulled said brush is lowered on the interior of said chimney, and when said chimney has been cleaned by said brush, said brush is removed from said rope and said chain, and one end of said chain is fastened directly to said snap ring and said rope is pulled out of said chimney to prevent said rope from burning and said chain engages with said first roller and said second roller and depends downward in said chimney after securing said rope to said external and fixed fastener.

2. A chimney sweeping devices as set forth in claim 1 wherein said first roller is rotatively mounted on the interior of said collar by end pins received in said collar and said second roller is rotatively mounted by pins and a pair of brackets, where said pins are received in said pair of brackets, and said brackets are fixedly secured to an outside surface of said collar and said rope engages with said first roller and said second roller and elevates said cleaning brush when pulled by a user.

* * * * *